US007724246B2

(12) United States Patent
Akimoto et al.

(10) Patent No.: US 7,724,246 B2
(45) Date of Patent: May 25, 2010

(54) IMAGE DISPLAY DEVICE

(75) Inventors: Hajime Akimoto, Kokubunji (JP); Hiroshi Kageyama, Hachioji (JP)

(73) Assignee: Hitachi Displays, Ltd., Mobara-shi (JP)

( * ) Notice: Subject to any disclaimer, the term of this patent is extended or adjusted under 35 U.S.C. 154(b) by 916 days.

(21) Appl. No.: 11/485,293

(22) Filed: Jul. 13, 2006

(65) Prior Publication Data

US 2007/0030234 A1 Feb. 8, 2007

(30) Foreign Application Priority Data

Aug. 8, 2005 (JP) ..... 2005-229070

(51) Int. Cl.
*G09G 3/36* (2006.01)

(52) U.S. Cl. ..... 345/204; 345/98

(58) Field of Classification Search ..... 345/204, 345/98

See application file for complete search history.

(56) References Cited

U.S. PATENT DOCUMENTS 6,049,321 A * 4/2000 Sasaki ..... 345/99
6,157,358 A * 12/2000 Nakajima et al. ..... 345/96
6,778,163 B2 * 8/2004 Ozawa ..... 345/96
6,816,144 B2 * 11/2004 Tsuchi ..... 345/100
6,856,308 B2 * 2/2005 Akimoto et al. ..... 345/98
7,136,036 B2 * 11/2006 O'Donnell ..... 345/88
7,193,550 B2 * 3/2007 Yamaguchi et al. ..... 341/144
7,352,348 B2 * 4/2008 Hosaka et al. ..... 345/89
7,362,249 B2 * 4/2008 Kim et al. ..... 341/139
7,463,234 B2 * 12/2008 Morita ..... 345/98
7,474,302 B2 * 1/2009 Iisaka ..... 345/204
2002/0030620 A1 * 3/2002 Cairns et al. ..... 341/145
2002/0047826 A1 * 4/2002 Akimoto et al. ..... 345/100
2002/0047840 A1 * 4/2002 Fukuda ..... 345/212
2003/0085828 A1 * 5/2003 Tsutsui ..... 341/144
2004/0005747 A1 * 1/2004 Park et al. ..... 438/197

FOREIGN PATENT DOCUMENTS

JP 2003-005716 1/2003

* cited by examiner

*Primary Examiner*—Bipin Shalwala
*Assistant Examiner*—Afroza Y Chowdhury
(74) *Attorney, Agent, or Firm*—Antonelli, Terry, Stout & Kraus, LLP.

(57) ABSTRACT

A low price image display device which has a smaller number of mounted components and allows high-accuracy display, is provided by making proper use of both a high-accuracy, low-voltage DA converter IC and a DA converter circuit having high-voltage TFTs formed on an insulated substrate in accordance with a display signal value.

18 Claims, 13 Drawing Sheets

IMAGE DISPLAY DEVICE

CLAIM OF PRIORITY

The present application claims priority from Japanese application JP 2005-229070 filed on Aug. 8, 2005, the content of which is hereby incorporated by reference into this application.

FIELD OF THE INVENTION

The present invention relates to a low price image display device which has a smaller number of mounted components and allows high-accuracy display.

BACKGROUND OF THE INVENTION

Related arts are hereunder explained with FIGS. 12 and 13.

Firstly, the structure of a first embodiment in the related arts is explained with FIG. 12. FIG. 12 is a circuit configuration diagram of a liquid crystal display by a related art. Each of the pixels constituting a display screen 203 includes a pixel switch 202 and a liquid crystal capacitor 201, and counter electrodes of the liquid crystal capacitors 201 are connected commonly to each other. The gate of each pixel switch 202 is connected to a gate wire driver IC (Integrated Circuit) 207 via a gate wire 204 and the other terminal of each pixel switch 202 is connected to a liquid crystal driver IC 208 having a DA converter circuit via a signal wire 205.

Here, the display screen 203, the gate wires 204, and the signal wires 205 are formed on a glass substrate 206. As a pixel switch 202 which is an active element, an amorphous silicon TFT (Thin Film Transistor) is used.

Next, operations of the first embodiment in the related arts are explained.

When the liquid crystal driver IC 208 applies an analog signal voltage to the signal wires 205 on the basis of input digital image data, in synchronization with that, the gate wire driver IC 207 selects prescribed gate wires 204 and turns on the pixel switches 202 in corresponding rows. Thereby, the analog signal voltage which the liquid crystal driver IC 208 has output is written in the liquid crystal capacitors 201 of the selected pixels and an optical image is displayed.

By such a related art, it is possible to display an image on the basis of input digital image data and the related art is now widely used for a liquid crystal display using the amorphous silicon TFTs.

In the meantime, a technology on a liquid crystal display using polycrystalline silicon TFTs which is different from the aforementioned technology is also known well. The structure of such a second embodiment in the related arts is hereunder explained with FIG. 13.

FIG. 13 is a circuit configuration diagram of a liquid crystal display showing the second embodiment in the related arts. Each of the pixels constituting a display screen 203 includes a pixel switch 202 and a liquid crystal capacitor 201, and counter electrodes of the liquid crystal capacitors 201 are connected commonly to each other. The gate of each pixel switch 202 is connected to a vertical scanning circuit 210 via a gate wire 204 and the other terminal of each pixel switch 202 is connected to a DA converter circuit 211 via a signal wire 205.

Here, the display screen 203, the gate wires 204, the signal wires 205, the vertical scanning circuit 210, and the DA converter circuit 211 are formed on a glass substrate 206. Then polycrystalline silicon TFTs are used as a pixel switch 202 which is an active element and the constituent elements of the vertical scanning circuit 210 and the DA converter circuit 211.

Next, operations of the second embodiment in the related arts are explained.

When the DA converter circuit 211 applies an analog signal voltage to the signal wires 205 on the basis of input digital image data, in synchronization with that, the vertical scanning circuit 210 selects prescribed gate wires 204 and turns on the pixel switches 202 in corresponding rows. Thereby, the analog signal voltage which the DA converter circuit 211 has output is written in the liquid crystal capacitors 201 of the selected pixels and an optical image is displayed.

By such a second related art, it is possible to display an image on the basis of input digital image data and details of such a related art are described in JP-A No. 005716/2003 for example.

SUMMARY OF THE INVENTION

In the case of the liquid crystal display of the first embodiment in the related arts, it has been necessary to mount a gate wire driver IC and a liquid crystal driver IC thereon and hence the problem has been that the number of mounted components has increased. Further, since a sufficiently high voltage is required for the outputs of the gate wire driver IC and the liquid crystal driver IC so as to be written in a liquid crystal capacitor, it has been difficult to lower the voltage and thus it has been necessary to adopt a costly high-voltage LSI process.

The liquid crystal display of the second embodiment in the related arts is devised in order to address the above problems and has the advantages of fewer mounted components and a lower price. However, since the properties of a polycrystalline silicon TFT constituting a DA converter which generates analog signal voltage vary more than the properties of a transistor element disposed on a silicon substrate which is generally used for an IC, a newly arising problem of the second embodiment in the conventional technologies has been that a high-accuracy DA converter circuit is hardly constructed.

The present invention is to provide a low price image display device which has a smaller number of mounted components and allows high-accuracy display.

An embodiment of a typical means in the present invention is as follows. That is, an image display device according to an embodiment of the present invention is the image display device provided with: a digital image signal generator; a DA converter of converting a digital image signal generated by the digital image signal generator into an analog signal; plural pixels arranged on an insulated substrate to display an image on the basis of the analog signal generated by the DA converter; and an analog signal writing section of writing the analog signal in prescribed pixels, wherein: the DA converter includes a first DA converter and a second DA converter which has a configuration different from the configuration of the first DA converter; the amplitude range of an analog signal output from the second DA converter is different from the amplitude range of an analog signal output from the first DA converter; the analog signal writing section includes an analog signal selector of selecting either one of an analog signal output from the second DA converter and an analog signal output from the first DA converter on the basis of the value of the digital image signal; and the first DA converter is disposed on a substrate which is different from the substrate on which the second DA converter is disposed.

The present invention makes it possible to provide a low price image display device which has a smaller number of mounted components and allows high-accuracy display.

BRIEF DESCRIPTION OF THE DRAWINGS

FIG. 5A shows a MOS transistor disposed on a control IC and FIG. 5B shows a polycrystalline silicon TFT disposed on a glass substrate;

DETAILED DESCRIPTION OF THE PREFERRED EMBODIMENTS

Preferable embodiments of an image display device according to an embodiment of the present invention are hereunder explained in detail in reference to attached drawings.

Embodiment 1

The configuration and operations of the first embodiment of an image display device according to an embodiment of the present invention are hereunder explained sequentially using FIGS. 1 to 4, FIG. 5A, and FIG. 5B.

Figure 1:
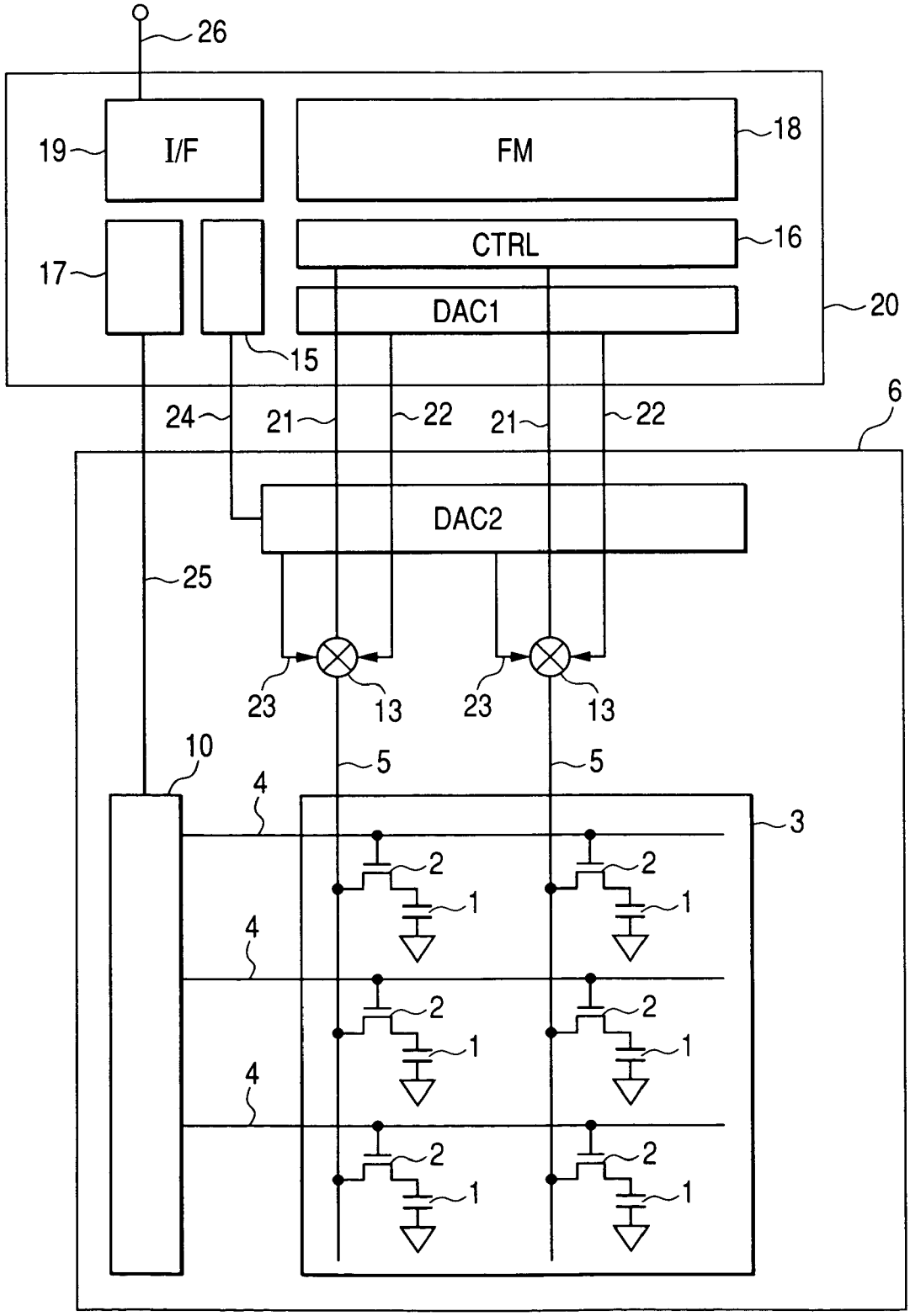
FIG. 1 is a circuit configuration diagram of a liquid crystal display explaining a first embodiment of an image display device according to an embodiment of the present invention.

FIG. 1 is a circuit configuration diagram of a liquid crystal display as the first embodiment. Each of pixels constituting a display screen 3 includes a pixel switch 2 and a liquid crystal capacitor 1, and counter electrodes of the liquid crystal capacitors 1 are connected commonly to each other. Further, a gate of a pixel switch 2 is connected to a vertical scanning circuit 10 via a gate wire 4, and the other terminal of the pixel switch 2 is connected to an analog selection switch 13 via a signal wire 5. Outputs 23, 22, and 21 from a second DA converter circuit (DAC2), a first DA converter circuit (DAC1), and a selection switch control circuit (CTRL) 16, respectively, are input into an analog selection switch 13. Furthermore, inputs 25 and 24 from a control circuit for the vertical scanning circuit 17 and a data input circuit for the DAC2 15 are connected to the vertical scanning circuit 10 and the DAC2, respectively.

Here, the display screen 3, the gate wires 4, the signal wires 5, the analog selection switches 13, the DAC2, and the vertical scanning circuit 10 are constructed on a glass substrate 6 using polycrystalline silicon TFTs. Further, the DAC1, the selection switch control circuit 16, the control circuit for the vertical scanning circuit 17, the data input circuit for the DAC2 15, a frame memory (FM) 18, and an interface circuit (I/F) 19 having a digital input terminal 26 are disposed on a control IC 20.

Next, operations of the present embodiment are briefly explained hereunder.

On the basis of digital image data which are input into the digital input terminal 26 and stored in the frame memory 18, the control IC 20 drives the DAC1, the selection switch control circuit 16, the DAC2, and the vertical scanning circuit 10. Although details are described later, the DAC1 or the DAC2 applies an analog signal voltage to the signal wires 5 via the analog selection switches 13, and the vertical scanning circuit 10 selects prescribed gate wires 4 in synchronization with the analog signal voltage and turns on the pixel switches 2 in the corresponding rows. By so doing, the analog signal voltage output from the DAC1 or the DAC2 is written in the liquid crystal capacitors 1 of the selected pixels and an image is optically displayed. At this time, the role of the analog selection switches 13 is to connect the DAC1 or the DAC2 alternatively to the signal wires 5, and the role of the selection switch control circuit 16 is to control the analog selection switch 13 of each column individually.

Figure 2:
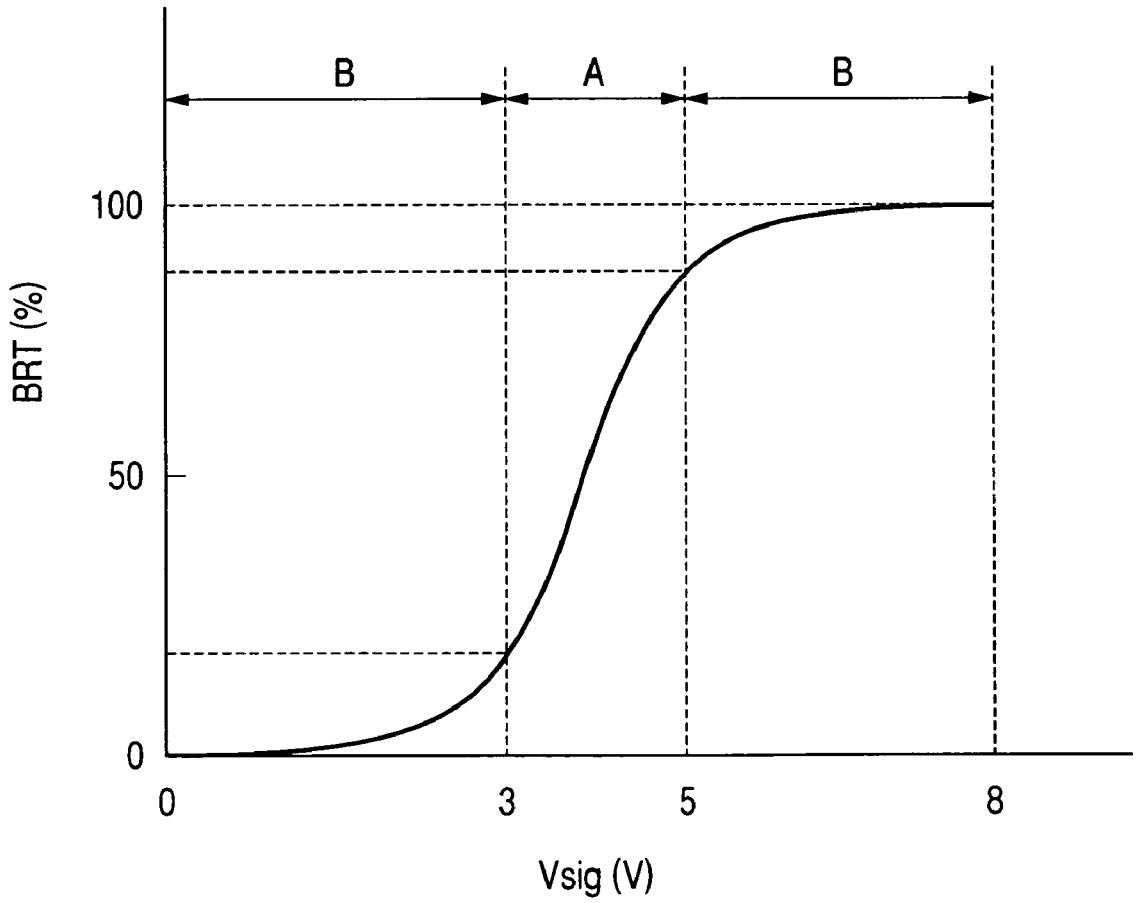
FIG. 2 is a graph showing the relationship between an analog signal voltage and a display brightness in a liquid crystal capacitor according to the first embodiment.

Here, selective operations of the DAC1 and the DAC2 are explained. FIG. 2 is a graph showing the relationship between an analog signal voltage and a display brightness in the liquid crystal capacitor 1 of a pixel. The horizontal axis represents an analog signal voltage Vsig (V) and the vertical axis represents a brightness BRT (%). As it is generally known, the optical transparency of a liquid crystal capacitor is expressed by such an S-shaped curve as shown in FIG. 2 and the brightness increases most steeply in the vicinity of the middle of the voltage.

In the present embodiment shown in FIG. 2, the analog signal voltage is varied in the range from 0 to 8 V and the inclination of the curve is particularly large in the range from 3 to 5 V as shown by the reference character "A" in the figure. That is, when an analog signal voltage is in the range from 3 to 5 V as shown by the reference character "A" in the figure, it is necessary to control the analog signal voltage with a very high degree of accuracy. In contrast, it is understood that, when an analog signal voltage is in the range from 0 to 3 V or from 5 to 8 V as shown by the reference character "B" in the figure, the control range of the analog signal voltage is wide but it is not necessary to control the analog signal voltage with such a very high degree of accuracy.

In the present embodiment consequently, when an analog signal voltage is in the range shown by the reference character "A" in the figure, writing is carried out with such a high degree of accuracy that the variation of the voltage is in the range of ±5 mV by using the DAC1 and, when an analog signal voltage is in the range shown by the reference character "B" in the figure, writing is carried out with the voltage accuracy of ±50 mV by using the DAC2. In this case, the required amplitude of the output signal voltage of the DAC1 is at most 2 Vpp and it is possible to realize a low-voltage IC having the maximum withstand voltage of 3.3 V at a low cost. Here, detailed descriptions are omitted since versatile technologies are discussed, and alternating voltage of 0 to 8 V for driving is applied to the common counter electrodes of the liquid crystals.

Figure 3:
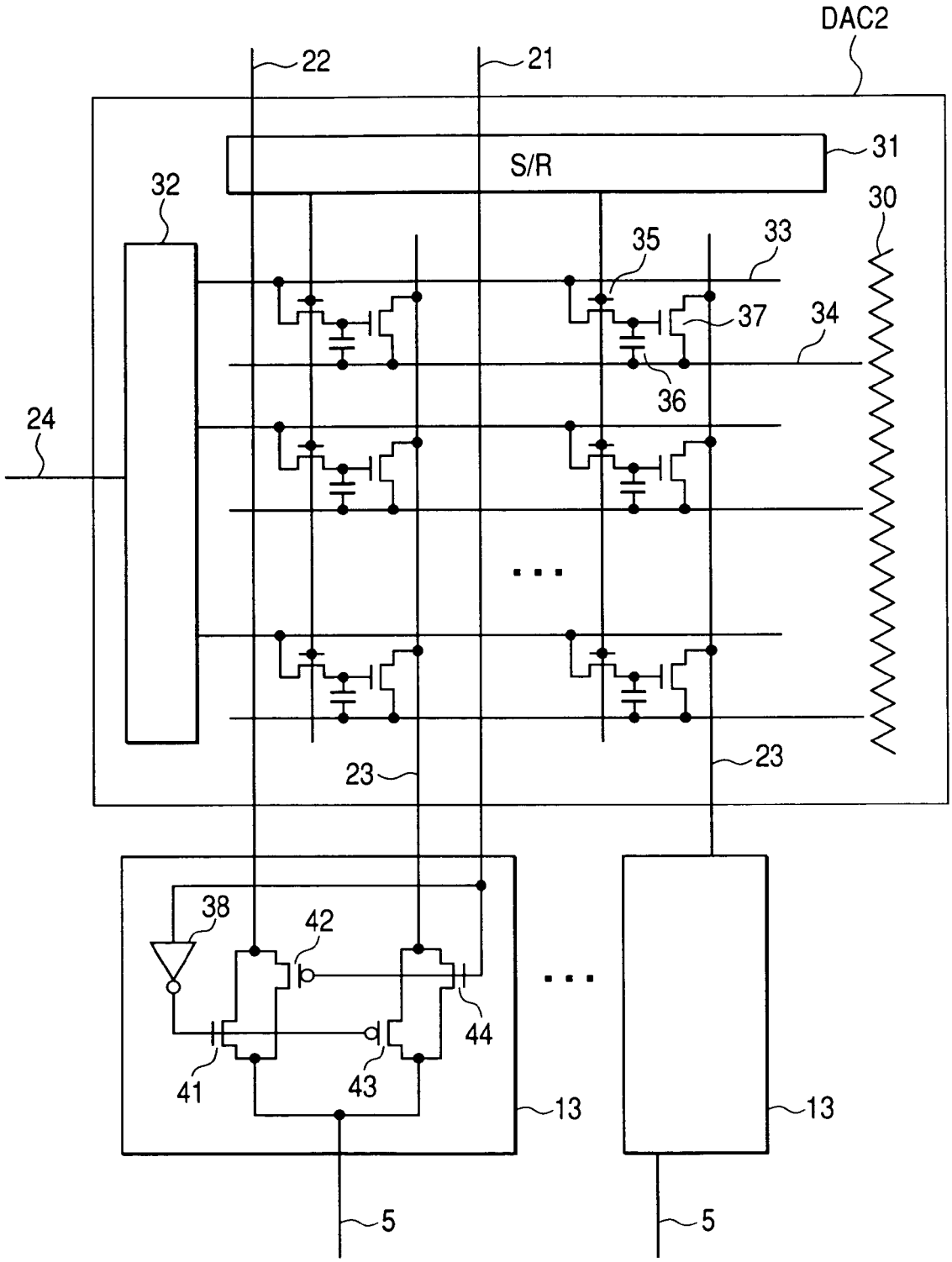
FIG. 3 is a configuration diagram of a second DA converter circuit and an analog selection switch in the first embodiment.

Next, the configurations of the DAC2 and an analog selection switch 13 are explained in more detail with FIG. 3.

FIG. 3 is a configuration diagram of the DAC2 and an analog selection switch 13. The output 24 from the data input circuit for the DAC2 15 is input into a decoder circuit 32, and decode signal wires 33 which are selected by the decoded digital signal data extend from the decoder circuit 32. Selector circuits each of which includes TFT switches 35 and 37 and a memory capacitor 36 are connected to the decode signal wires 33 in the form of a matrix. The input to a TFT switch 35 which is controlled with a shift register circuit (S/R) 31 is input into a memory capacitor 36 and the gate of a TFT switch 37. The other terminal of the memory capacitor 36 and a terminal of the TFT switch 37 are connected to a gradation voltage wire 34 extending from a ladder resistance for analog voltage generation 30 and the other terminal of the TFT switch 37 is connected to a second analog output wire 23 and led to an analog selection switch 13.

To an analog selection switch 13, connected are, besides the aforementioned second analog output wire 23, a first analog output wire 22 which is led from the DAC1 and a control wire 21 which is led from the selection switch control circuit 16.

In an analog selection switch 13, the first analog output wire 22 and the second analog output wire 23 are connected to a signal wire 5 via CMOS (Complementary Metal Oxide Semiconductor) analog switches 41, 42, 43 and 44 which are turned on alternately. The CMOS analog switches 41 to 44 are controlled with the control wire 21 and an inverter circuit 38 to which the control wire 21 is led.

Figure 4:
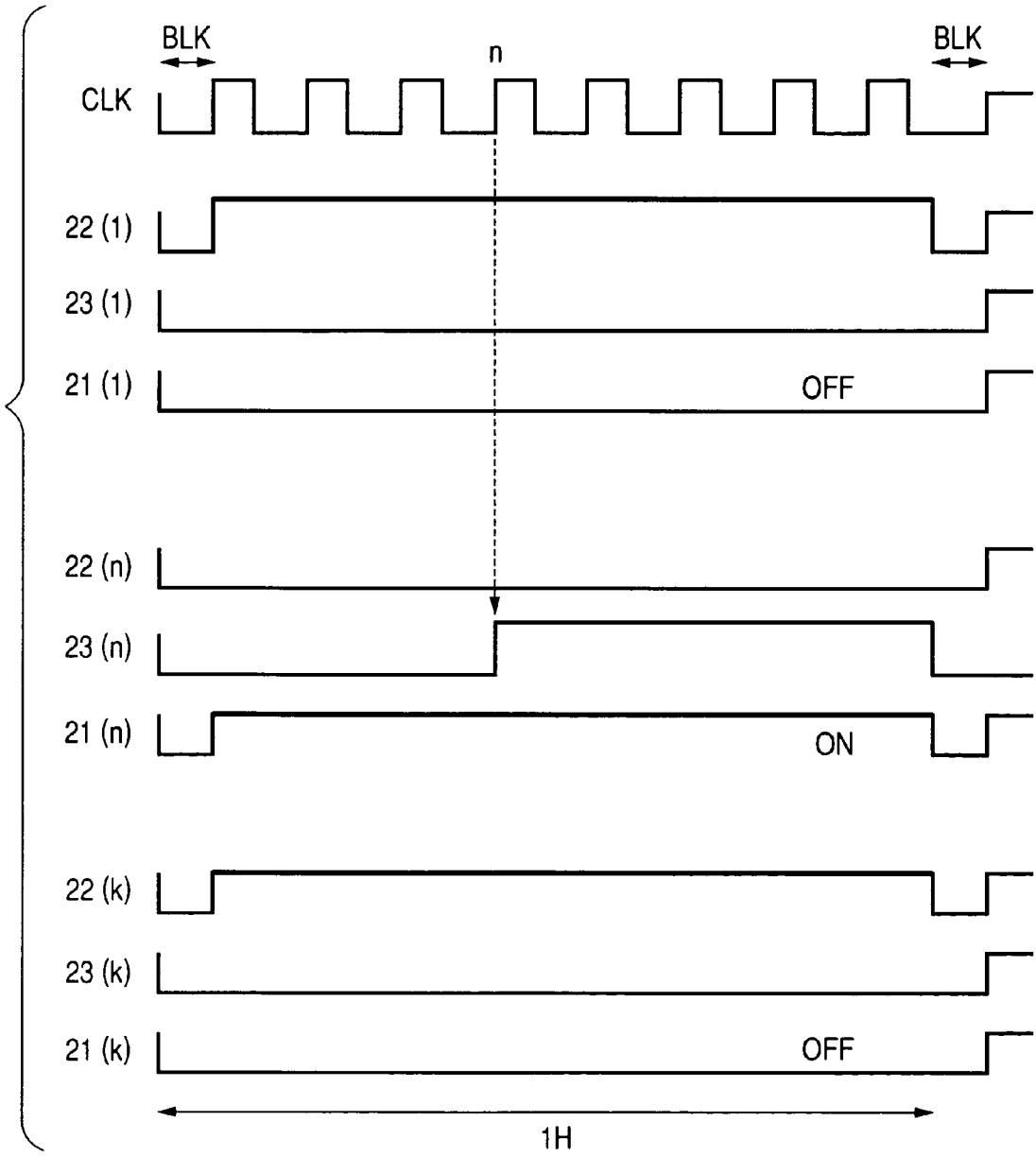
FIG. 4 is an operation timing chart in the first embodiment.

Next, the operations of the DAC2 and an analog selection switch 13 are explained in more detail with FIG. 4.

FIG. 4 is an operation timing chart showing a horizontal dot clock CLK which is also the clock of the shift register circuit (S/R) 31 and the first analog output wire 22, the second analog output wire 23, and the control wire 21 in the first column, the n-th column, and the k-th column (those are represented by (1), (n), and (k) respectively in the figure), respectively. A term corresponding to one horizontal scanning period (1H) is shown here. When a horizontal blanking period BLK is finished at the first stage of one horizontal scanning period (1H), the control wire 21 for each column turns on or turns off, and instructs whether the first analog output wire 22 or the second analog output wire 23 is connected to a signal wire 5.

Here, "turn off" means that the first analog output wire 22 is connected to a signal wire 5, and "turn on" means that the second analog output wire 23 is connected to a signal wire 5. In this case, by the function of the analog selection switch 13, the analog signal voltage output to the first analog output wire 22 is input into a signal wire 5 at the columns where the control wire 21 is turned off and the analog signal voltage output to the second analog output wire 23 is input into a signal wire 5 at the columns where the control wire 21 is turned on.

In this case further, digital signal voltages are written sequentially in the decoder 32 of the DAC2 in conformity with the horizontal dot clock CLK. At this time, the decoder 32 turns on some of the decode signal wires 33 in response to the decoded signal also in conformity with the horizontal dot clock CLK. The decode data are sampled in a prescribed memory capacitor 36 with a TFT switch 35 connected to the shift register circuit 31 which is controlled with the horizontal dot clock CLK, and the sampling signal makes the corresponding gradation voltage wire 34 extending from the ladder resistance for analog voltage generation 30 connected to the second analog output wire 23 via a TFT switch 37. Through the above operations, the DAC2 outputs an analog signal voltage to the second analog output wire 23 of the n-th column with the n-th clock.

Note that, the circuit configuration of single piece of such a DAC2 is described in detail in JP-A No. 005716/2003 which represents the related arts described earlier.

Meanwhile, it has been described earlier that: the display screen 3, the gate wires 4, the signal wires 5, the analog selection switches 13, the DAC2, and the vertical scanning circuit 10 are constructed on a glass substrate 6 using polycrystalline silicon TFTs; and, in contrast, the DAC1, the selection switch control circuit 16, the control circuit for the vertical scanning circuit 17, and the data input circuit for the DAC2 15, the frame memory 18, and the interface circuit 19 having the digital input terminal 26 are formed on the control IC 20. In this regard, a polycrystalline silicon TFT formed on a glass substrate 6 and a MOS transistor formed on a control IC 20 are further explained with FIG. 5.

Figure 5A:
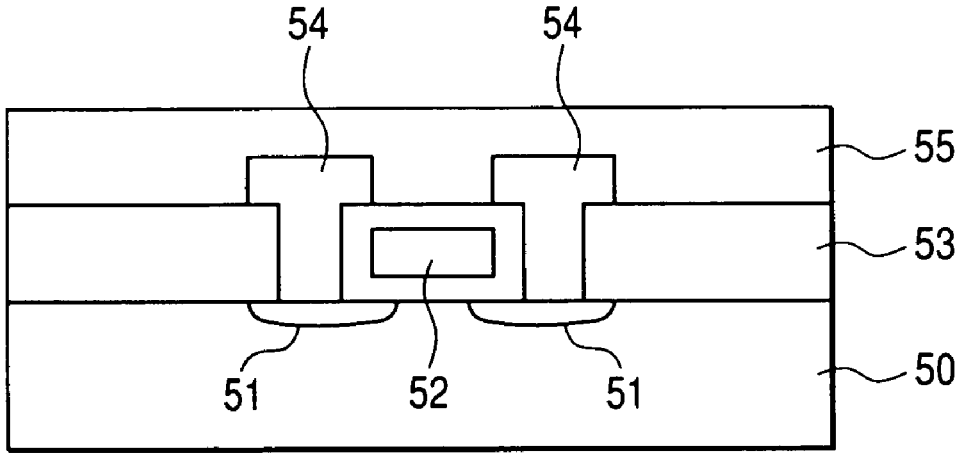
FIG. 5A and FIG. 5B are sectional views showing the structures of transistors in the first embodiment.
Figure 5B:
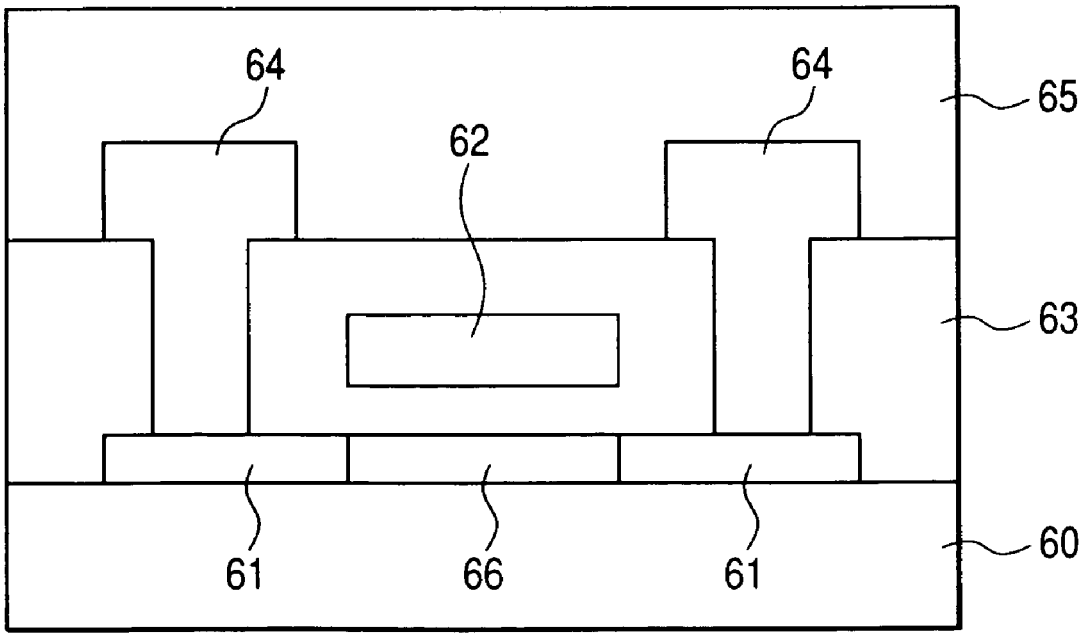

FIG. 5A is a sectional view of the structure of a MOS transistor formed on a control IC 20 and FIG. 5B is a sectional view of the structure of a polycrystalline silicon TFT formed on a glass substrate 6. A MOS transistor is configured so as to form impurity diffusion layers 51, a gate electrode 52, and an insulating film 53 on a Si substrate 50, and further electrodes 54 and a protective film 55 are formed thereon.

On the other hand, the polycrystalline silicon TFT includes a polycrystalline silicon thin film having high-concentration impurity diffusion regions 61 and a channel region 66 formed on a glass substrate 60, a gate electrode 62 and an insulating film 63, and further electrodes 64 and a protective film 65 are formed thereon. As stated earlier, in the case of a MOS transistor, it is possible to reduce the area, thereby lower the price, and improve the performance of the transistor by downsizing the gate electrode 52 and simultaneously reducing the thickness of the insulating film under the gate electrode, but in contrast the resistance to high voltage deteriorates. In the present embodiment, a 3.3 V withstand voltage process is applied in order to lower the price.

In the meantime, in the case of a polycrystalline silicon TFT, since it involves a large-size glass substrate process, the size of the gate electrode 62 is hardly reduced and the variation of properties is comparatively large, and hence it is difficult to realize a high-accuracy DA converter, but in contrast it is possible to enhance the resistance to high voltage by increasing the thickness of the insulating film under the gate electrode. In the present embodiment too, a polycrystalline silicon TFT realizes a high withstand voltage of 10 V or higher.

Note that, although a polycrystalline silicon TFT on a glass substrate is used as a high-voltage transistor in the above Embodiment 1, not only polycrystalline silicon but also another organic or inorganic semiconductor thin film formed on an insulated substrate may be used as a transistor.

Further, although the second DA converter circuit (DAC2) is constructed with polycrystalline silicon TFTs in the present embodiment, it is also possible to dispose a part thereof, like the decoder circuit 32 for example, on the control IC 20 as a part of optimum design.

Embodiment 2

Figure 6:
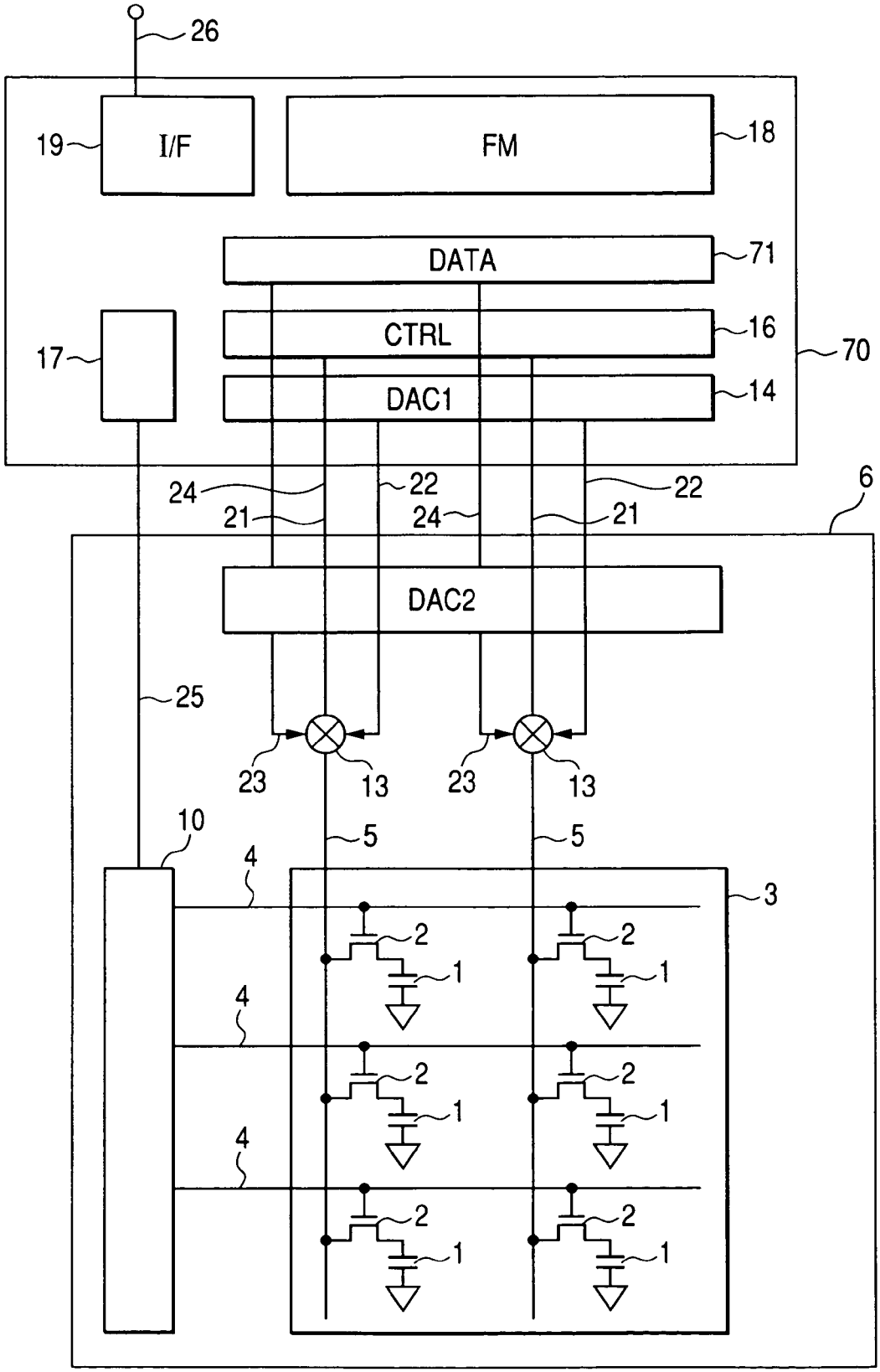
FIG. 6 is a circuit configuration diagram of a liquid crystal display explaining a second embodiment of an image display device according to the present invention.
Figure 7:
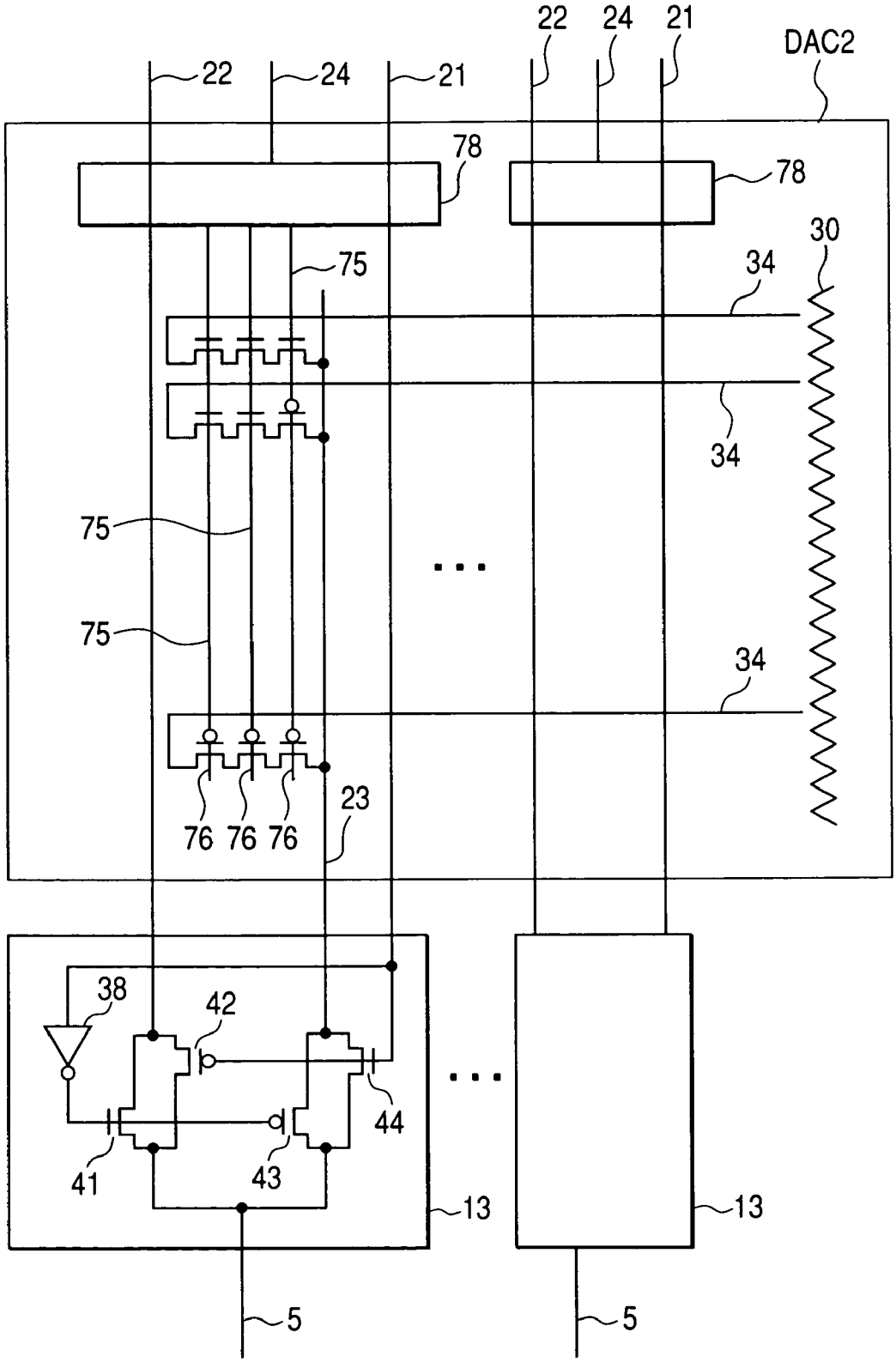
FIG. 7 is a configuration diagram of a second DA converter circuit and an analog selection switch in the second embodiment.
Figure 8:
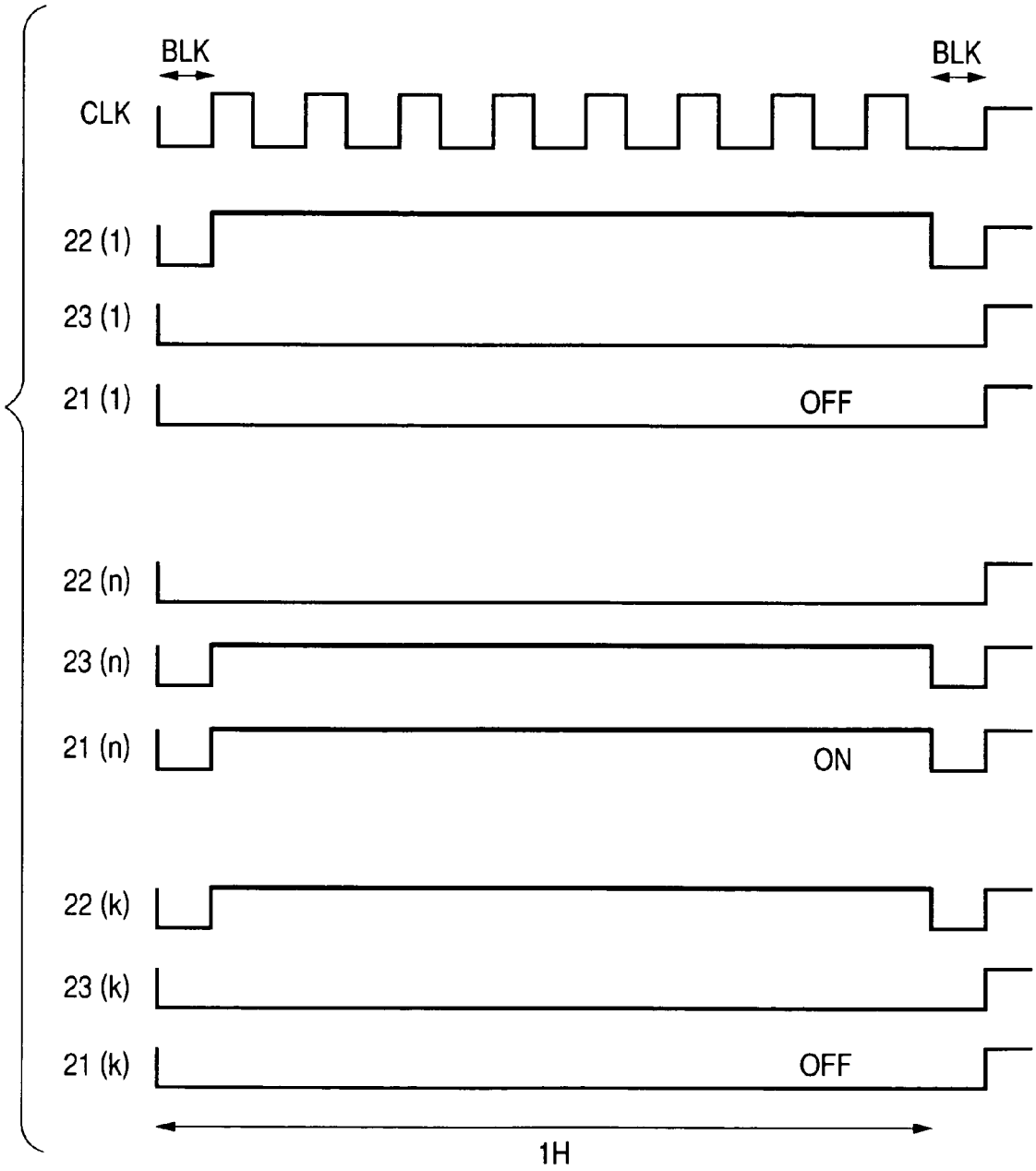
FIG. 8 is an operation timing chart in the second embodiment.

The second embodiment of an image display device according to an embodiment of the present invention is explained with FIGS. 6 to 8.

FIG. 6 is a circuit configuration diagram of a liquid crystal display as the second embodiment. Each of pixels constituting a display screen 3 includes a pixel switch 2 and a liquid crystal capacitor 1, and counter electrodes of the liquid crystal capacitors 1 are connected commonly to each other. Further, a gate of a pixel switch 2 is connected to a vertical scanning circuit 10 via a gate wire 4, and the other terminal of the pixel switch 2 is connected to an analog selection switch 13 via a signal wire 5. Outputs 23, 22, and 21 from a DAC2, a DAC1, and a selection switch control circuit (CTRL) 16, respectively, are input into the analog selection switch 13. Furthermore, inputs 25 and 24 from a control circuit for the vertical scanning circuit 17 and a data input circuit for the DAC2 (DATA) 71 are input into the vertical scanning circuit 10 and the DAC2, respectively.

Here, the display screen 3, the gate wires 4, the signal wires 5, the analog selection switches 13, the DAC2, and the vertical scanning circuit 10 are constructed on a glass substrate 6 using polycrystalline silicon TFTs. Further, the DAC1, the selection switch control circuit 16, the control circuit for the vertical scanning circuit 17, the data input circuit for the DAC2 (DATA) 71, a frame memory (FM) 18, and an interface circuit (I/F) 19 having a digital input terminal 26 are disposed on a control IC 70.

Next, operations of the present embodiment are briefly explained hereunder.

On the basis of digital image data which are input into the digital input terminal 26 and stored in the frame memory 18, the control IC 70 drives the DAC1, the selection switch control circuit 16, the DAC2, and the vertical scanning circuit 10. Although details are described later, the DAC1 or the DAC2 applies an analog signal voltage to the signal wires 5 via the analog selection switches 13, and the vertical scanning circuit 10 selects prescribed gate wires 4 in synchronization with the analog signal voltage and turns on the pixel switches 2 in the corresponding rows. By so doing, the analog signal voltage output from the DAC1 or the DAC2 is written in the liquid crystal capacitors 1 of the selected pixels and an image is optically displayed.

At this time, the role of the analog selection switches 13 is to connect the DAC1 or the DAC2 alternatively to the signal wires 5, and the role of the selection switch control circuit 16 is to control the analog selection switch 13 of each column individually.

Here, with regard to the sharing of the analog signal voltage between the DAC1 and the DAC2, the contents are the same as those already explained with FIG. 2 in Embodiment 1 and hence explanations are omitted here.

Next, the configurations of the DAC2 and an analog selection switch 13 are explained in more detail with FIG. 7.

FIG. 7 is a configuration diagram of the DAC2 and an analog selection switch 13 in the present embodiment. An output 24 from the data input circuit for the DAC2 71 is input into a parallel latch circuit 78. The latched digital signal data are output from the parallel latch circuit 78 to latch signal wires 75. TFT switches 76 to which the latch signal wires 75 are led constitute a decode circuit. The decode circuit: selects gradation voltage wires 34 extending from a ladder resistance for analog voltage generation 30; and inputs the selected gradation voltage as an analog signal output into an analog selection switch 13 connected to a second analog output wire 23.

To an analog selection switch 13, connected are, besides the aforementioned second analog output wire 23, a first analog output wire 22 which is led from the DAC1 and a control wire 21 which is led from the selection switch control circuit 16. However, the configuration and the operations of the analog selection switch 13 are the same as those stated earlier in Embodiment 1 and hence the explanations are omitted here.

Next, the operations of the DAC2 and an analog selection switch 13 are explained in more detail with FIG. 8.

FIG. 8 is an operation timing chart showing a horizontal dot clock CLK and the first analog output wire 22, the second analog output wire 23, and the control wire 21 in the first column (1), the n-th column (n), and the k-th column (k), respectively. A term corresponding to one horizontal scanning period (1H) is shown here. When a horizontal blanking period BLK is finished at the first stage of one horizontal scanning period (1H), the control wire 21 for each column is turned on or turned off, and instructs whether the first analog output wire 22 or the second analog output wire 23 is connected to a signal wire 5. Here, "turn off" means that the first analog output wire 22 is connected to a signal wire 5, and "turn on" means that the second analog output wire 23 is connected to a signal wire 5. In this case, by the function of the analog selection switch 13: the analog signal voltage output to the first analog output wire 22 is input into a signal wire 5 at the columns where the control wire 21 is turned off; and the analog signal voltage output to the second analog output wire 23 is input into a signal wire 5 at the columns where the control wire 21 is turned on.

In this case, at the columns where the control wire 21 is turned on, the output 24 from the data input circuit for the DAC2 (DATA) 71 is input into the parallel latch circuit 78, and the DAC2 outputs the analog signal voltage decoded with the TFT switches 76 to the analog output wire 23.

In the present embodiment too, the display screen 3, the gate wires 4, the signal wires 5, the analog selection switches 13, the DAC2, and the vertical scanning circuit 10 are constructed on a glass substrate 6 using polycrystalline silicon TFTs. In contrast, the DAC1, the selection switch control circuit 16, the control circuit for the vertical scanning circuit 17, the data input circuit for the DAC2 71, the frame memory 18, and the interface circuit 19 having the digital input terminal 26 are formed on a control IC 70. In this regard, a polycrystalline silicon TFT formed on a glass substrate 6 and a MOS transistor formed on a control IC 70 are the same as those explained earlier with FIG. 5 in Embodiment 1 and hence the explanations are omitted.

In Embodiment 2, intended display functions can be realized by the aforementioned operations. In particular, since the operation period of the DAC2 is one horizontal scanning period (1H) which is long unlike the case of Embodiment 1, it is possible to realize a large-sized display having a large signal wire capacity. Further, in order to realize a yet larger-sized display, it is only necessary to insert a buffer amplifier circuit in a second analog output wire 23 and apply impedance conversion.

Embodiment 3

Figure 9:
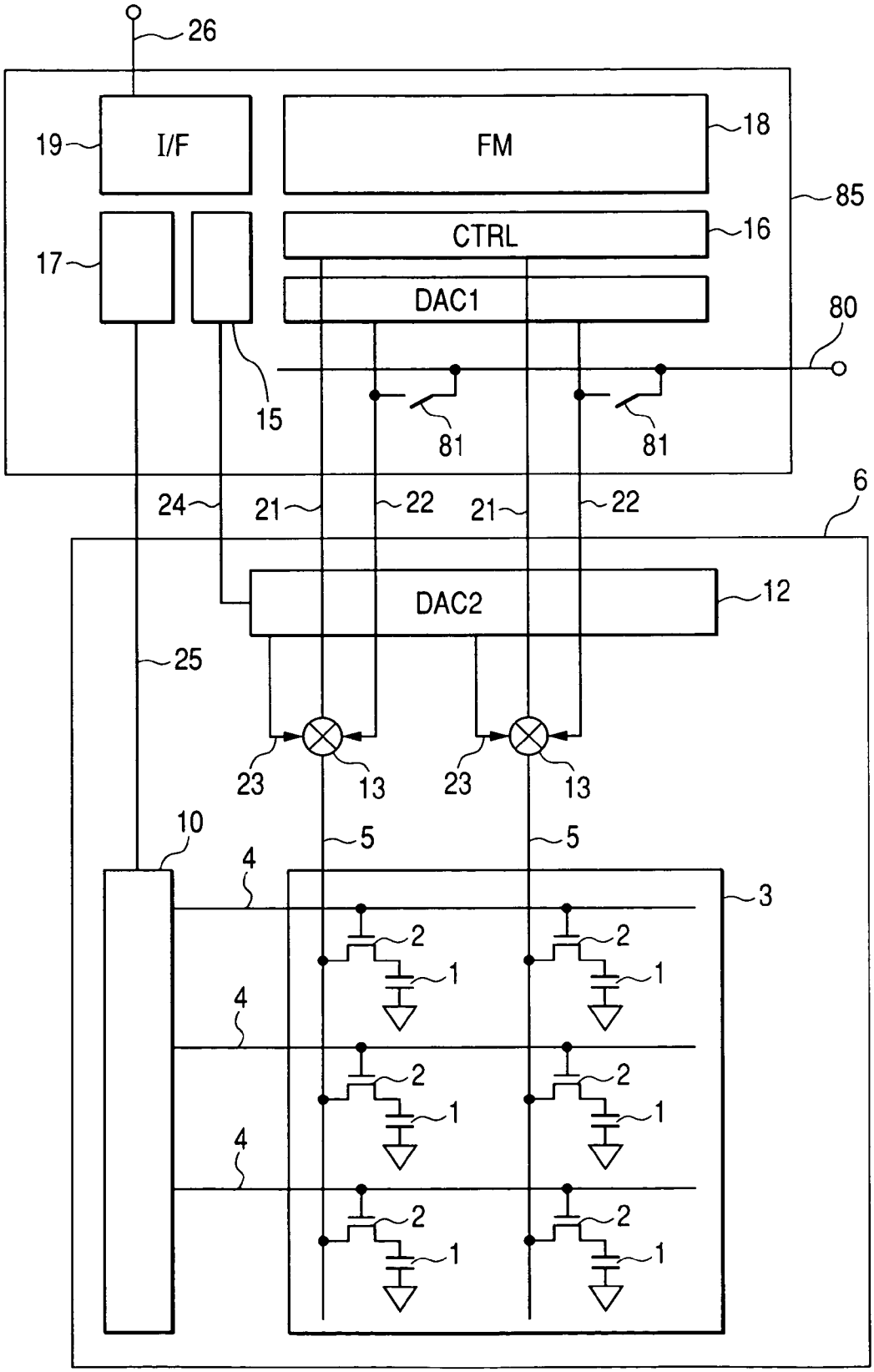
FIG. 9 is a circuit configuration diagram of a liquid crystal display explaining a third embodiment of an image display device according to the present invention.
Figure 10:
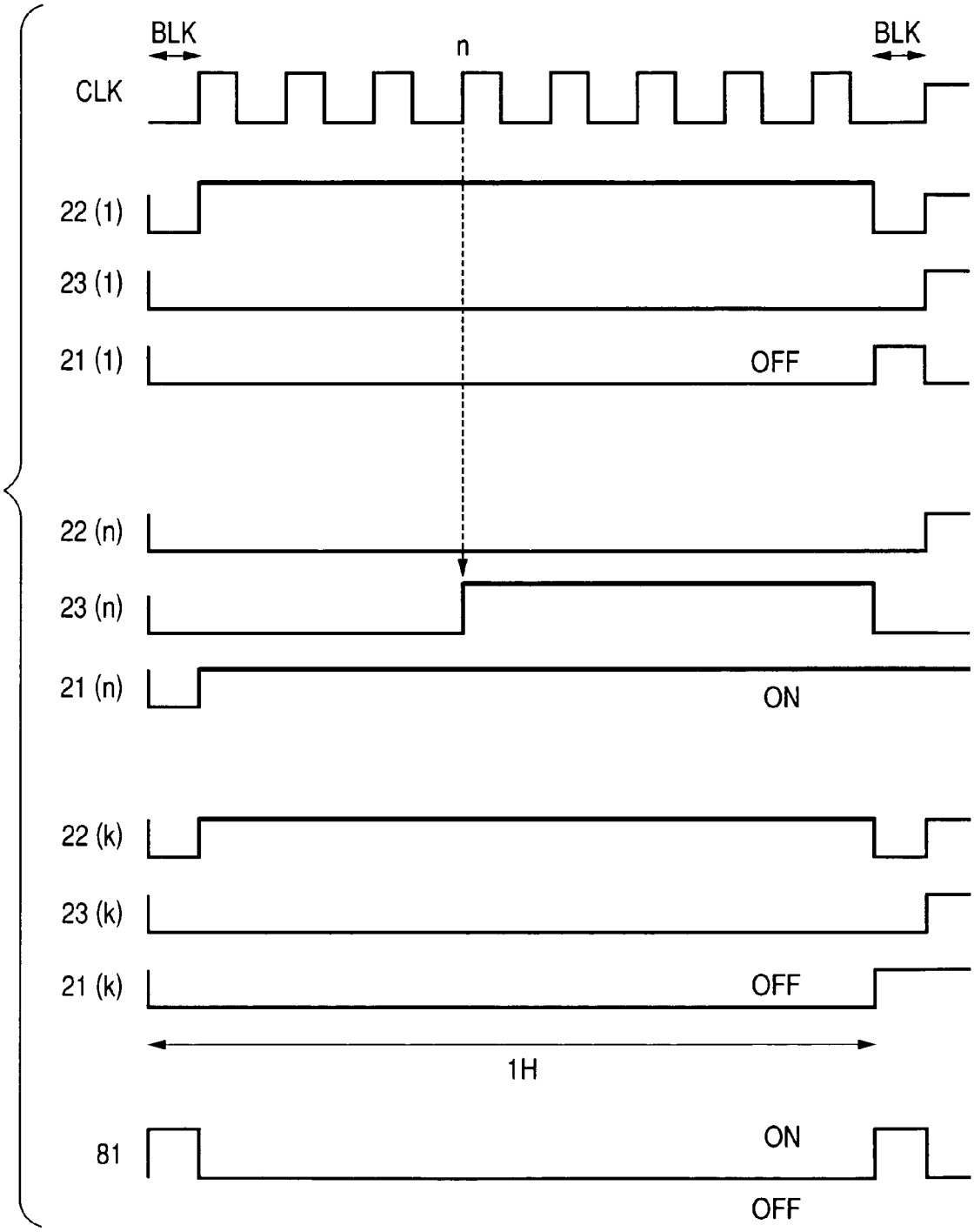
FIG. 10 is an operation timing chart in the third embodiment.

The third embodiment of an image display device according to an embodiment of the present invention is explained with FIGS. 9 and 10.

The configuration and operations of a liquid crystal display in the present embodiment are basically the same as those in Embodiment 1. A difference from Embodiment 1 is that a control IC 85 is provided with a precharge power source wire 80 and precharge switches 81, and thus those are explained hereunder.

FIG. 9 is a circuit configuration diagram of a liquid crystal display in the present embodiment. In the present embodiment, each of first analog output wires 22 in a control IC 85 is provided with the precharge power source wire 80 and a precharge switch 81. By so doing, it is possible to reset or precharge an analog signal voltage which has been written during a previous horizontal scanning period and has remained on a signal wire 5 via an analog selection switch 13 and the first analog output wire 22 at the first stage of one horizontal scanning period (1H).

Next, precharge operations with the DAC1 are explained in more detail with FIG. 10.

FIG. 10 is an operation timing chart showing a horizontal dot clock CLK, the first analog output wire 22, the second analog output wire 23, and the control wire 21 in the first column (1), the n-th column (n), and the k-th column (k), respectively, and a precharge switch 81. A term corresponding to one horizontal scanning period (1H) is shown here. At the first stage of one horizontal scanning period (1H), at the same time as the control wires 21 are concurrently turned off during the horizontal blanking period BLK, the precharge switches 81 are concurrently turned on and the analog signal voltage which has been written during the previous horizontal scanning period and has remained on the signal wires 5 is reset or precharged to the voltage of the precharge power source wire 80 via the analog selection switches 13 and the first analog output wires 22.

In this case, when the reset or precharged voltage is set at the median of the output dynamic range of the DAC1, thereby in the present embodiment, it is possible to avoid the stroke caused by the residual signal of the previous rows and simultaneously increase the speed of the writing to the signal wires 5.

The operations other than the above precharge operations are the same as the operations already described in Embodiment 1 and hence the explanations are omitted here.

Note that, although the precharge circuit is disposed in the control IC 85 in the present embodiment, it is also possible to dispose a polycrystalline silicon TFT circuit on a glass substrate likewise.

Embodiment 4

Figure 11:
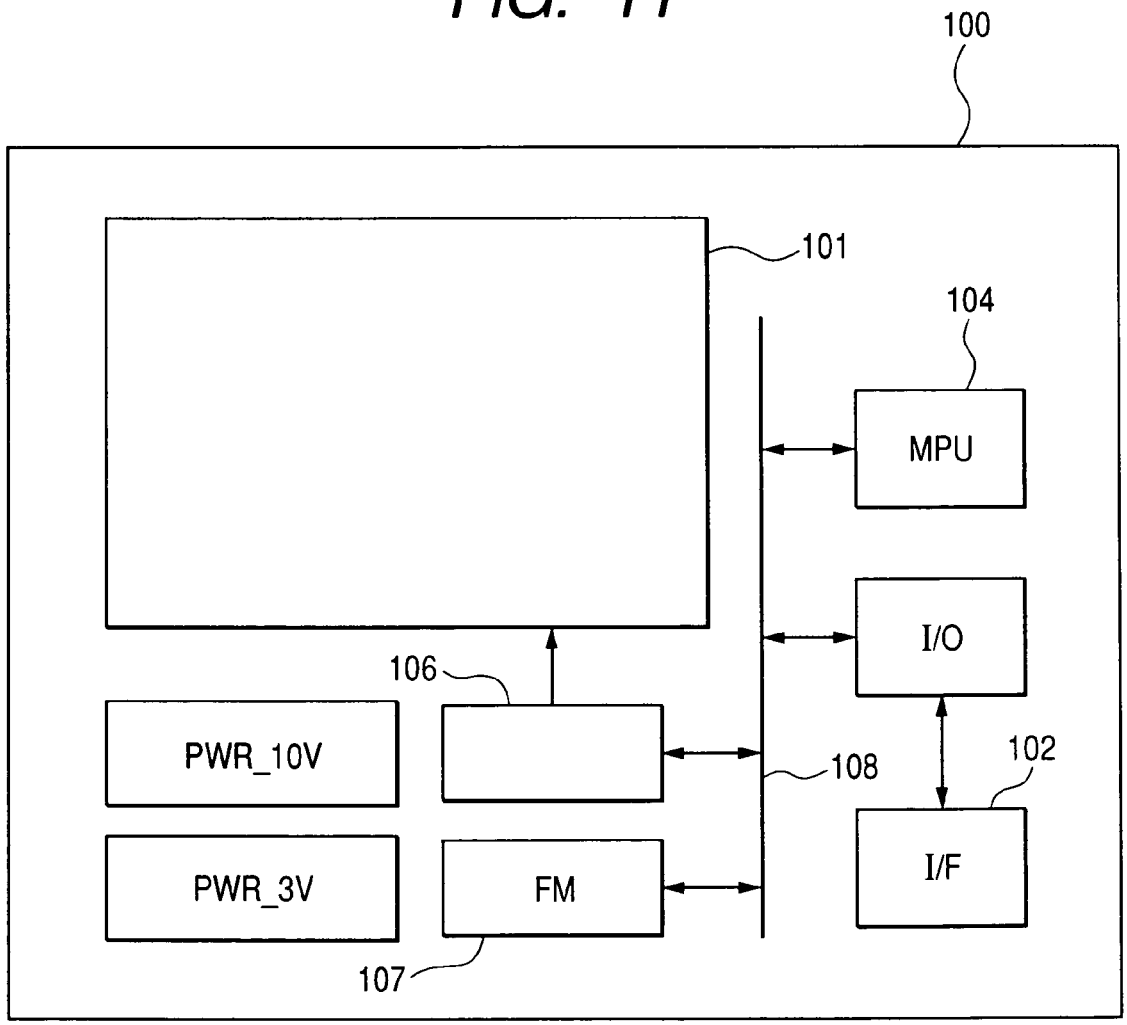
FIG. 11 is a configuration diagram of a TV image display device explaining a fourth embodiment of an image display device according to the present invention.
Figure 12:
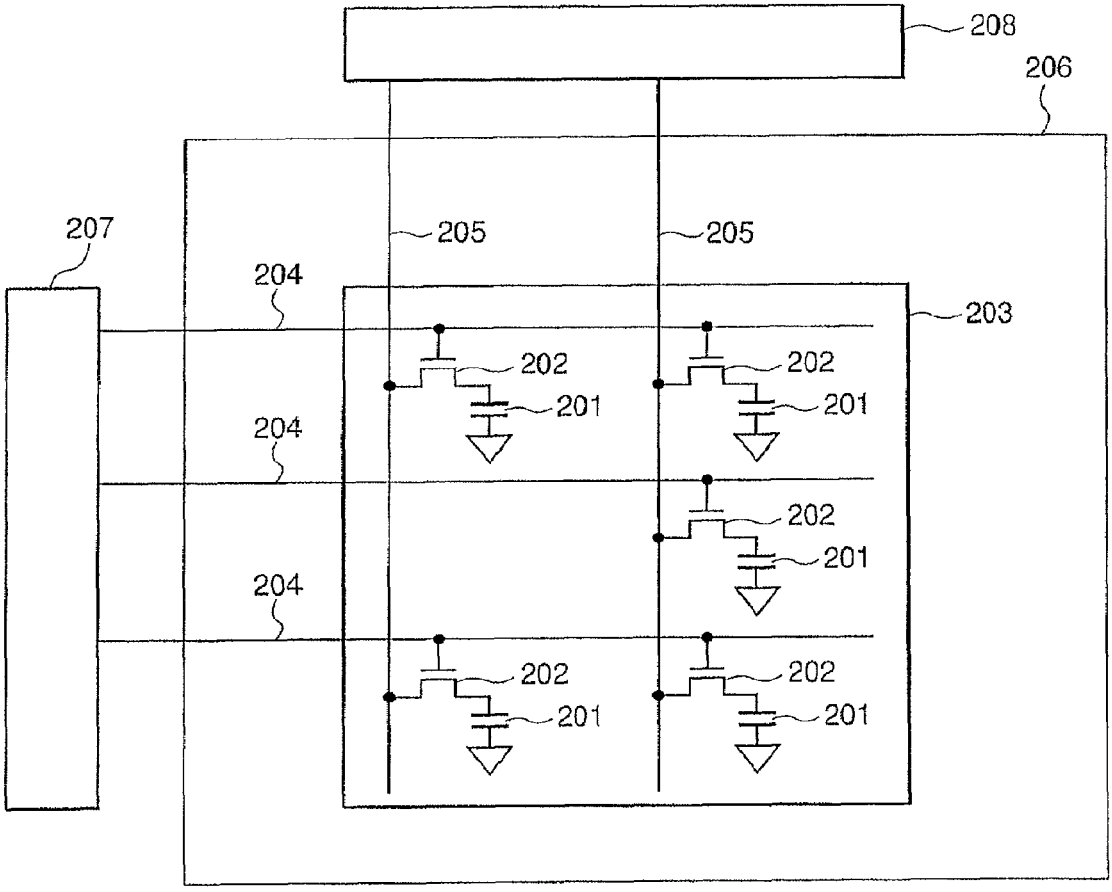
PRIOR ART FIG. 12
FIG. 12 is a circuit configuration diagram of a liquid crystal display explaining a first embodiment of conventional technologies.
Figure 13:
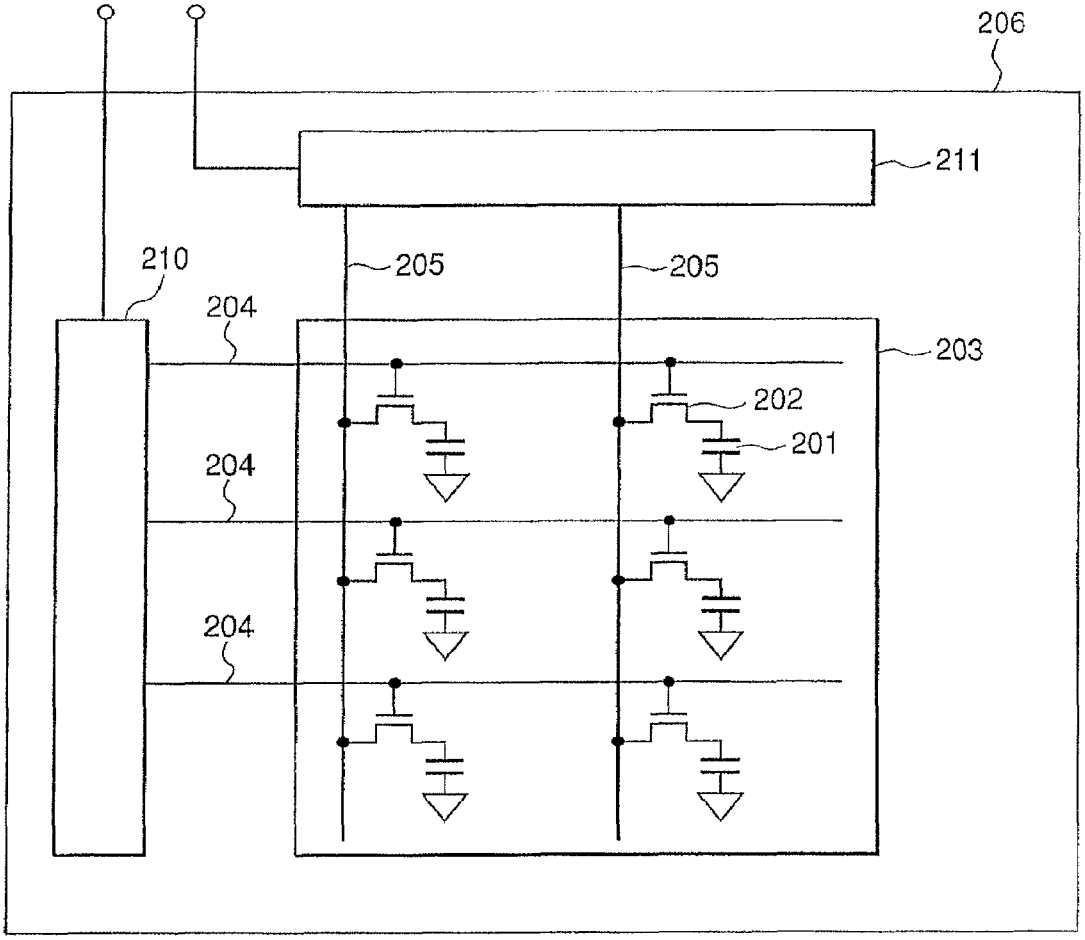
PRIOR ART FIG. 13
FIG. 13 is a circuit configuration diagram of a liquid crystal display explaining a second embodiment of conventional technologies.

The fourth embodiment of an image display device according to an embodiment of the present invention is explained with FIG. 11.

FIG. 11 is a configuration diagram of a TV image display device 100 in the present embodiment. Compressed image data or the like are input as wireless data from outside to a wireless interface (I/F) circuit 102 which receives a terrestrial wave digital signal or the like, and the output from the wireless I/F circuit is led to a data bus 108 via an input-output circuit (I/O) 103. To the data bus 108, besides the above, a microprocessor (MPU) 104, a display panel controller 106, a frame memory 107 and others are connected. Further, the output of the display panel controller 106 is input into a liquid crystal display 101. Further in the TV image display device 100, an off-panel 10V generating circuit (PWR_10V) and an off-panel 3V generating circuit (PWR_3V) are disposed. Here, the configuration and operations of the liquid crystal display 101 are basically the same as those of Embodiment 1 already described earlier and hence the detailed descriptions on the interior configuration and operations thereof are omitted. Although they are not shown in the figure, the same components as Embodiment 1 are explained with the same reference marks.

Operations of the present embodiment are explained hereunder. Firstly, the wireless I/F circuit 102 takes in image data compressed in response to command from outside and transfers the image data to the microprocessor 104 and the frame memory 107 via the I/O circuit. The microprocessor 104 receives command operation from a user, drives the entire image display terminal 100 as needed, and carries out the decoding, signal processing and information displaying of the compressed image data. The image data subjected to the signal processing can be stored temporarily in the frame memory 107.

Here, when the microprocessor 104 issues a display command, in accordance with the command, image data are input into the liquid crystal display 101 from the frame memory 107 via the display panel controller 106 and the liquid crystal display 101 displays the input image data in real time. On this occasion, the display panel controller 106 outputs a prescribed timing pulse necessary for the simultaneous display of the image and the off-panel 10V generating circuit PWR_10V and the off-panel 3V generating circuit PWR_3V supply a prescribed power source voltage to the liquid crystal display 101. Here, the output from the off-panel 10V generating circuit PWR_10V is input into the polycrystalline silicon TFT circuit on the glass substrate and the output from the off-panel 3V generating circuit PWR_3V is input into a control IC 20 not shown in the figure. Note that, even in the case where image data are not input, the liquid crystal display 101 displays an image written beforehand by a frame memory 18, not shown in the figure, disposed in the interior. Further, although a secondary battery is separately included in the TV image display device 100 and supplies electric power to drive the entire TV image display device 100, this is not an essential point of the present invention and thus the explanations thereon are omitted here.

By the means of the present embodiment, the number of mounted components around a liquid crystal display 101 is small and hence it is possible to provide a low price TV image display device 100 which is excellent in compactness and designability and allows high-accuracy display.

Note that, although the liquid crystal display explained in Embodiment 1 is used as the image display device in the present embodiment, it is obviously possible to use a display panel having a structure other than the structure of the liquid crystal display as long as it satisfies the tenor of the present invention.

What is claimed is:

1. An image display device comprising:

a first DA converter which converts a first digital signal data to a first analog signal voltage;

a second DA converter which converts a second digital signal data to a second analog signal voltage;

a plurality of pixels arranged on an insulated substrate;

analog selection switches; and signal wires which are connected to the pixels;

wherein an amplitude range of the first analog signal voltage is different from an amplitude range of the second analog signal voltage;

wherein each of the analog selection switches connects the second DA converter with one of the signal wires when the second analog voltage is between a first voltage and a second voltage or between a third voltage and a fourth voltage;

wherein each of the analog selection switches connects the first DA converter with one of the signal wires when the first analog voltage is between the second voltage and the third voltage; and wherein the first DA converter is disposed on a substrate which is different from a substrate on which the second DA converter is disposed.

2. The image display device according to claim 1, wherein the first DA converter is disposed on a semiconductor substrate and the second DA converter is disposed on the insulated substrate.

3. The image display device according to claim 1, wherein a MOS transistor element is used as a constituent element of the first DA converter; and a TFT element is used as a constituent element of the second DA converter.

4. The image display device according to claim 1, wherein each of the pixels has a liquid crystal cell and a plurality of electrodes to apply an electric field.

5. The image display device according to claim 1, wherein the first DA converter has a plurality of DA converter circuits aligned in parallel.

6. The image display device according to claim 1, wherein the first DA converter is on a same substrate as a control circuit of an analog signal selector.

7. The image display device according to claim 1, wherein the first DA converter is on a same substrate as a frame memory for storing the digital image signal.

8. The image display device according to claim 1, wherein the first DA converter has a digital image signal output section to input signals into the second DA converter.

9. The image display device according to claim 1, wherein the first DA converter has a digital image signal output section aligned in parallel to input signals into the second DA converter.

10. The image display device according to claim 1, wherein the second DA converter has a decoder circuit, a selection switch matrix, and a reference voltage generating circuit.

11. The image display device according to claim 10, wherein the decoder circuit is disposed on a same substrate on which the first DA converter is disposed.

12. The image display device according to claim 1, wherein the second DA converter has a decoder circuit, a selection switch matrix, and a reference voltage generating circuit configured in parallel.

13. The image display device according to claim 1, wherein a dynamic range of an analog signal output from the second DA converter is wider than a dynamic range of an analog signal output from the first DA converter.

14. The image display device according to claim 1, wherein a repeatability error of an analog signal output from the first DA converter is smaller than a repeatability error of an analog signal output from the second DA converter.

15. The image display device according to claim 1, wherein a processing dimension of a transistor element constituting the first DA converter is smaller than a processing dimension of a transistor element constituting the second DA converter.

16. The image display device according to claim 1, wherein a withstand voltage of a transistor element constituting the first DA converter is smaller than a withstand voltage of a transistor element constituting the second DA converter.

17. An image display device comprising:

a control integrated circuit (IC), which includes a first digital/analog (DA) converter that converts a first digital signal data to a first analog signal voltage; and an insulated substrate, which is a different substrate from a substrate on which the control IC is disposed, and includes:

an analog selection switch;

pixels, connected to the analog selection switch via a signal wire, a second DA converter, which converts a second digital signal data to a second analog signal voltage, and which is connected to the analog selection switch by an analog output wire, and which is connected by the analog selection switch to the pixels via a signal wire when the second analog voltage is between a first voltage value and a second voltage value or between a third voltage value and a fourth voltage value;

wherein the analog selection switch connects the first DA converter with the signal wire and the pixels when the first analog voltage is between the second voltage value and the third voltage value; and wherein the amplitude range of the first analog signal voltage is different from the amplitude range of the second analog signal voltage.

18. The image display device according to claim 17, wherein the first DA converter is on the same substrate as a control circuit of an analog signal selector, and a frame memory for storing the digital image signal.

* * * * *